US006202894B1

(12) United States Patent
Struminski et al.

(10) Patent No.: US 6,202,894 B1
(45) Date of Patent: Mar. 20, 2001

(54) BEVERAGE DISPENSER WITH SYRUP CONCENTRATE CONTAINER

(75) Inventors: Krzysztof Struminski; Charles M. Fisher, both of Louisville, KY (US)

(73) Assignee: GrindMaster Corporation, Louisville, KY (US)

( * ) Notice: Subject to any disclaimer, the term of this patent is extended or adjusted under 35 U.S.C. 154(b) by 0 days.

(21) Appl. No.: 09/297,373

(22) PCT Filed: Oct. 31, 1997

(86) PCT No.: PCT/US97/19903

§ 371 Date: Jul. 1, 1999

§ 102(e) Date: Jul. 1, 1999

(87) PCT Pub. No.: WO98/19958

PCT Pub. Date: May 14, 1998

Related U.S. Application Data

(60) Provisional application No. 60/030,273, filed on Nov. 1, 1996.

(51) Int. Cl.[7] ..... B67D 5/56

(52) U.S. Cl. ..... 222/129.3; 222/145.6; 222/236

(58) Field of Search ..... 222/129.1, 129.3, 222/129.4, 145.2, 145.6, 146.6, 239, 236

(56) References Cited

U.S. PATENT DOCUMENTS

| | | |
|---|---|---|
| 2,140,471 | 12/1938 | Frolich et al. . |
| 3,276,633 | 10/1966 | Rahauser . |
| 3,323,681 | 6/1967 | Di Vette et al. . |
| 3,394,848 | 7/1968 | McCulloch . |
| 3,446,399 | 5/1969 | Ross et al. . |
| 4,324,494 | 4/1982 | Pryor et al. . |
| 4,360,128 | 11/1982 | Neumann . |
| 4,457,217 | 7/1984 | Ogawa et al. . |
| 4,493,249 | 1/1985 | Stover . |
| 4,753,370 | 6/1988 | Rudick . |
| 4,857,355 | 8/1989 | Gregg . |
| 5,303,846 | 4/1994 | Shannon . |
| 5,312,020 | 5/1994 | Frei . |
| 5,360,620 | 11/1994 | Hsu . |
| 5,549,222 | 8/1996 | Schroeder . |

FOREIGN PATENT DOCUMENTS

| | | |
|---|---|---|
| 3346280A1 | 12/1983 | (DE) . |
| 4137324C1 | 11/1991 | (DE) . |
| 2135276 | 8/1984 | (GB) . |
| 2137520 | 10/1984 | (GB) . |
| 2271758 | 4/1994 | (GB) . |

*Primary Examiner*—Kenneth Bomberg
(74) *Attorney, Agent, or Firm*—Vance A. Smith; Stites & Harbison

(57) ABSTRACT

The pre-mix beverage dispensing apparatus (10) includes an ice bank assembly (12) connected to a remote system of potable water at line pressure for the chilling of the potable water. The chilled water is carried at a regulated line pressure from the ice bank assembly (12) to a mixing valve/dispensing assembly (18) where the chilled water is metered into a prescribed amount and mixed with a proportionate amount of syrup metered from a syrup holding tank (64). The syrup tank (64) is provided with an agitating element (66) that periodicially agitates the syrup to prevent syrup constituents from precipitating out of solution or stratification of the syrup into various concentration levels. In one embodiment, the apparatus is provided with a hopper assembly (14) that stores and meters a powder flavorant to the syrup tank and components that deliver chilled water to the tank proportional to the powder flavorant metered into the tank (64).

18 Claims, 15 Drawing Sheets

BEVERAGE DISPENSER WITH SYRUP CONCENTRATE CONTAINER

This application claims benefit to provisional application 60/030,273 filed Nov. 1, 1996. This is a national stage application filed under 35 USC 371 of Application No. PCT/US 97/19903, filed Oct. 31, 1997.

BACKGROUND OF THE INVENTION

The present invention is related to beverage dispensers and more particularly to beverage dispensers that dispense beverages made from a syrup concentrate.

The numbers of beverage dispensers used in restaurants are significant and growing steadily, particularly with the increase of rapid food industries. Beverage dispensers are intended to facilitate the expeditious service required in the restaurant industry. Indeed, the customer is often invited to dispense directly his or her own drink into a container placed under the spout or nozzle of the dispenser. Such beverage dispensers can be categorized into two types: carbonated and non-carbonated beverage dispensers.

Carbonated drink beverage dispensers typically are formulated from a syrup which is mixed with a chilled carbonated water held under pressure. The non-refrigerated syrup is pumped from a location outside of the dispenser housing to a mixing and dispensing nozzle to be mixed with a predetermined quantity of chilled carbonated water. Some of the mixing occurs as the two liquids are actually discharged into a container. The syrup itself is frequently contained in a flexible bag and placed in a rigid container where the liquid is metered out of the bag by a pump upon demand. No mixing of the syrup and water occurs unless a drink is required and the amount mixed is only that required to satisfy the immediate need.

Non-carbonated dispensers are frequently characterized as "juice" dispensers and pre-mix dispensers. The former dispenses a beverage formulated from a thick, viscous concentrate and water under significant pressure and mixed thoroughly in a mixing chamber before being dispensed. The latter uses a refrigerated tank for holding the ready-to-drink beverage that is to be directly dispensed without further mixing. The pre-mix dispensers typically handle the popular beverages that are made from a powder and mixed with a requisite amount of water to form the beverage. It is the pre-mix dispenser that is the focus of the ensuing discussion.

Non-carbonated beverages may be formulated at the manufacturer, shipped directly to the serving establishment in large containers, and then distributed as needed directly into the into the individual dispenser holding containers. However, the large costs resulting from such shipments, primarily due to the weight of the water constituent of the beverage, have caused the beverage manufacturers to transfer the responsibility of adding water to complete the formulation of water to the employees of the beverage dispensing establishment. This permits the manufacturer to ship a syrup concentrate or powder to the establishments, avoiding the weight of the water. While this procedure does reduce shipping costs, it does expand the employee work load and, more importantly, increases the handling of the beverage constituents by employees on premise. The employees must measure, pour and transfer the formulated beverage to the dispenser. The added handling by the employees clearly increases the probability for errors to occur in the formulation of the beverage, distorting taste, or for adulteration of the beverage itself from contaminants or bacteria.

Non-carbonated pre-mix beverage dispensers located in restaurants require frequent replenishment during heavy use hours, posing a problem to management since the work required to replenish the dispenser is at the expense of other needed services of the employees. Hastily formulated beverages made by harried employees are more likely to have been formulated improperly or to have created hygiene problems. Moreover, the dispenser may also be rendered unusable for a period of time since the beverage added to the tank is initially at room temperature. Cooling of a large beverage holding tank often requires up to two hours or more of down time for that dispenser until the beverage is cooled to a desired serving temperature. The length of down time is exacerbated if the ambient temperature is high, for example in summer or tropical/desert regions.

It is therefore a primary object of the present invention to provide for a drink dispensing system having a housed syrup container and a chilled water supply from which a chilled beverage can be obtained upon demand. It is another object of the present invention to provide for a drink dispensing system that largely avoids the hygiene problems associated with the pre-mix beverage dispensing systems of the prior art. It is yet another object of the present invention to provide a drink dispensing system in which the down time frequently experienced in pre-mix drinking systems is substantially reduced or eliminated. It is still a further object of the present invention to provide for a drink dispensing system that occupies less space in establishments than the pre-mix drink dispensing systems of the prior art. These and other objects and advantages of the present invention will become apparent to those with ordinary skill in the art upon reading of this description accompanied by the appended drawings.

SUMMARY OF THE INVENTION

The objects above are addressed by an beverage dispenser system in accordance with one embodiment of the present invention that prepares and dispenses a selected beverage of a predetermined volume from a housed syrup container. The system includes an ice bank assembly connected to a remote system of potable water at line pressure for the chilling of said potable water. The chilled water is carried at a regulated line pressure from the ice bank assembly to a mixing valve dispensing assembly where the chilled liquid is metered into a prescribed amount and mixed with a proportionate amount of syrup received from a syrup holding tank. The syrup tank is provided with an agitating element that periodically agitates the syrup to prevent syrup constituents from precipitating out of solution or stratification of the syrup into various concentration levels. In one embodiment, the apparatus is provided with a hopper assembly that stores and meters a powder flavorant to the syrup tank and components that deliver chilled water to the tank proportional to the powder flavorant metered into the tank. The apparatus also provides for periodic flushing of the surfaces of the apparatus coming into contact with the syrup to promote hygiene.

DETAILED DESCRIPTION OF THE PREFERRED EMBODIMENT

Figure 2:
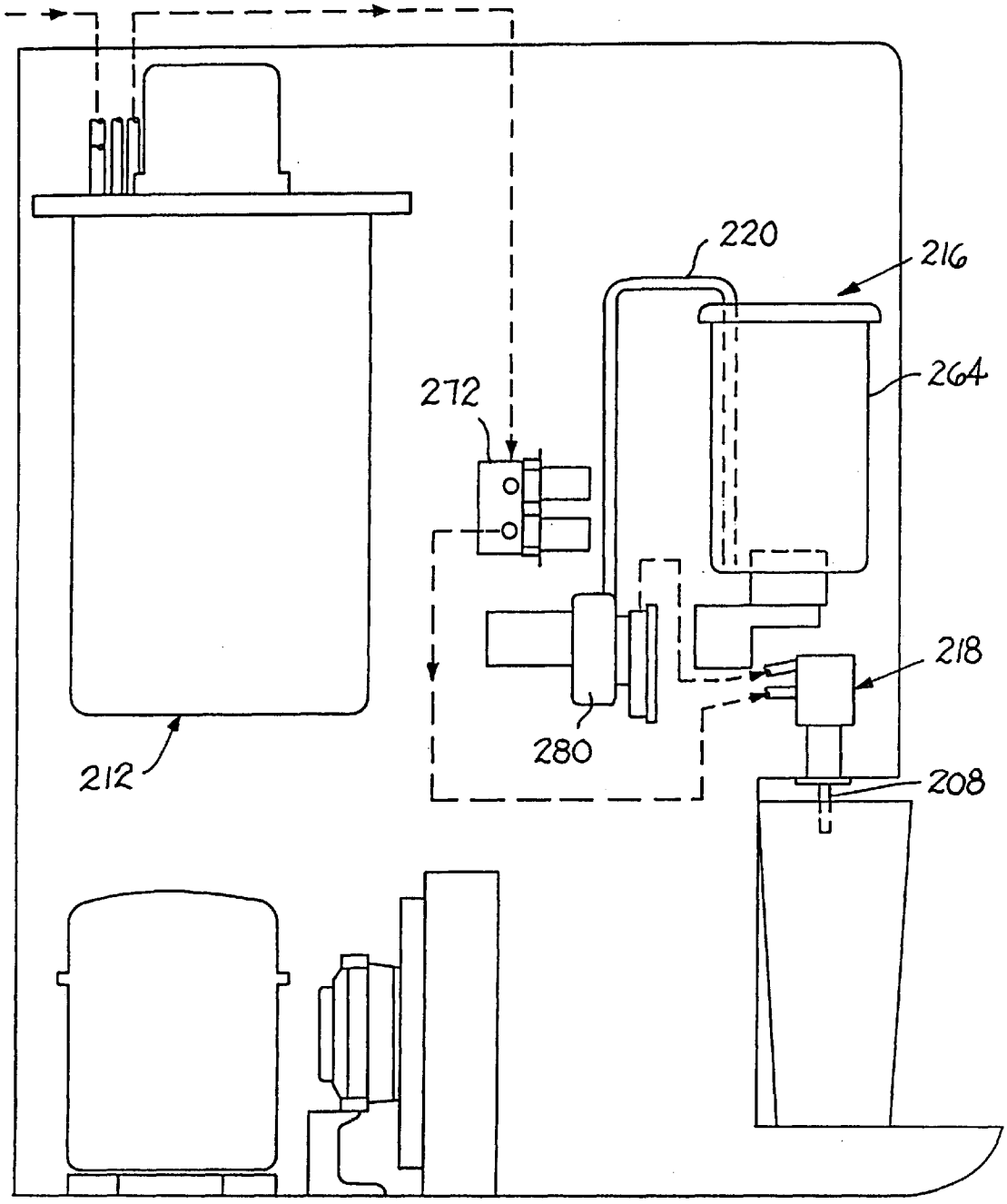
FIG. 2 is a side schematic of a beverage dispensing apparatus made in accordance with another embodiment of the present invention.
Figure 3:
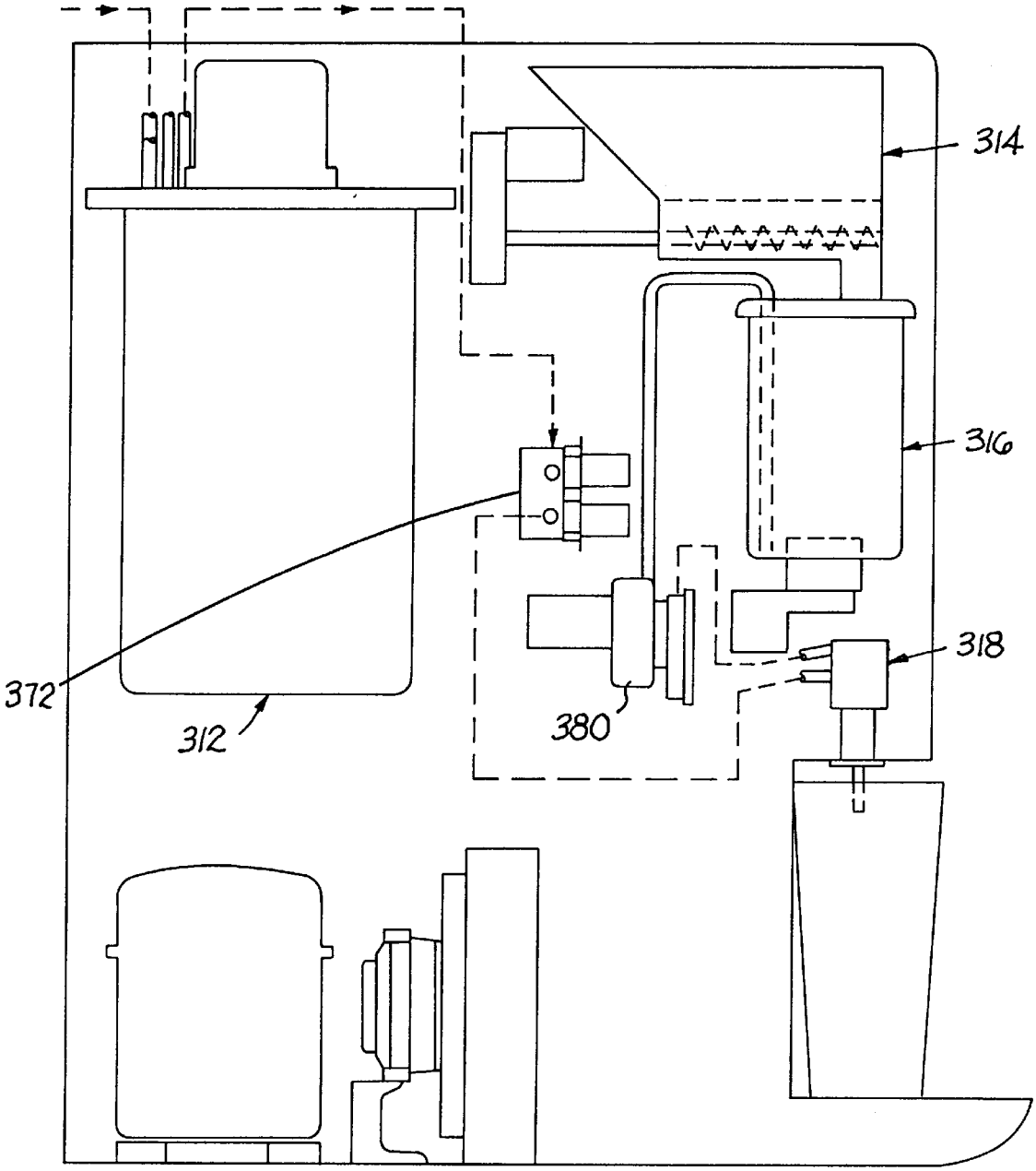
FIG. 3 is a side schematic of a beverage dispensing apparatus still another embodiment made in accordance with still another embodiment of the present invention.
Figure 4:
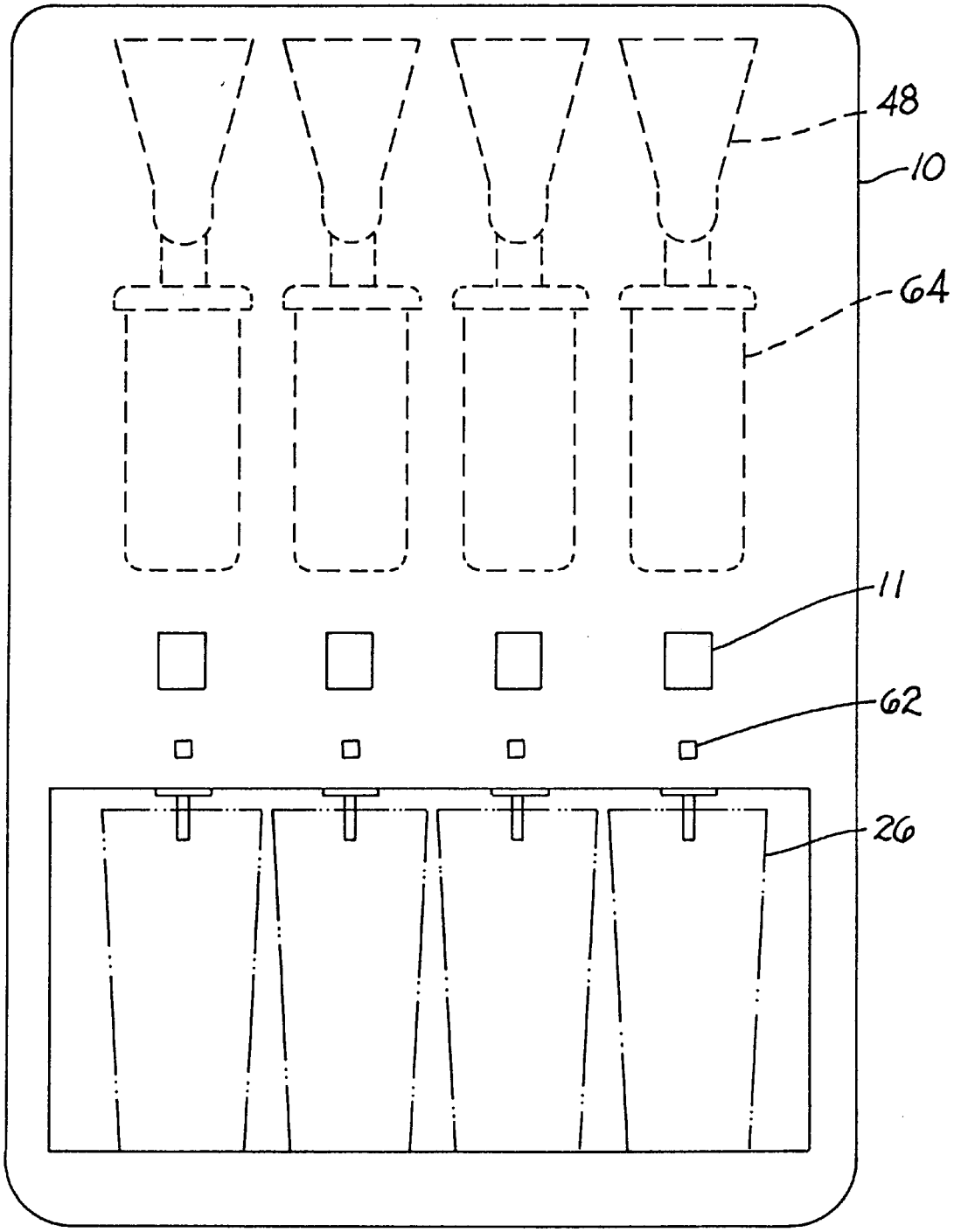
FIG. 4 is a front schematic of a beverage dispensing apparatus depicted in FIG. 1.

It should be understood that the preferred embodiment of the present invention pertains to a multi-unit dispenser, each unit being capable of delivering on demand a beverage of a particular flavor. This is best illustrated in the front schematic view of a four unit apparatus that allows an operator to select from one of four beverages. For the sake of clarity, however, the majority of the discussion is limited to the components of one unit With the side schematics of FIGS. 1, 2 and 3 illustrating a single dispensing unit and the major components thereof.

Figure 1:
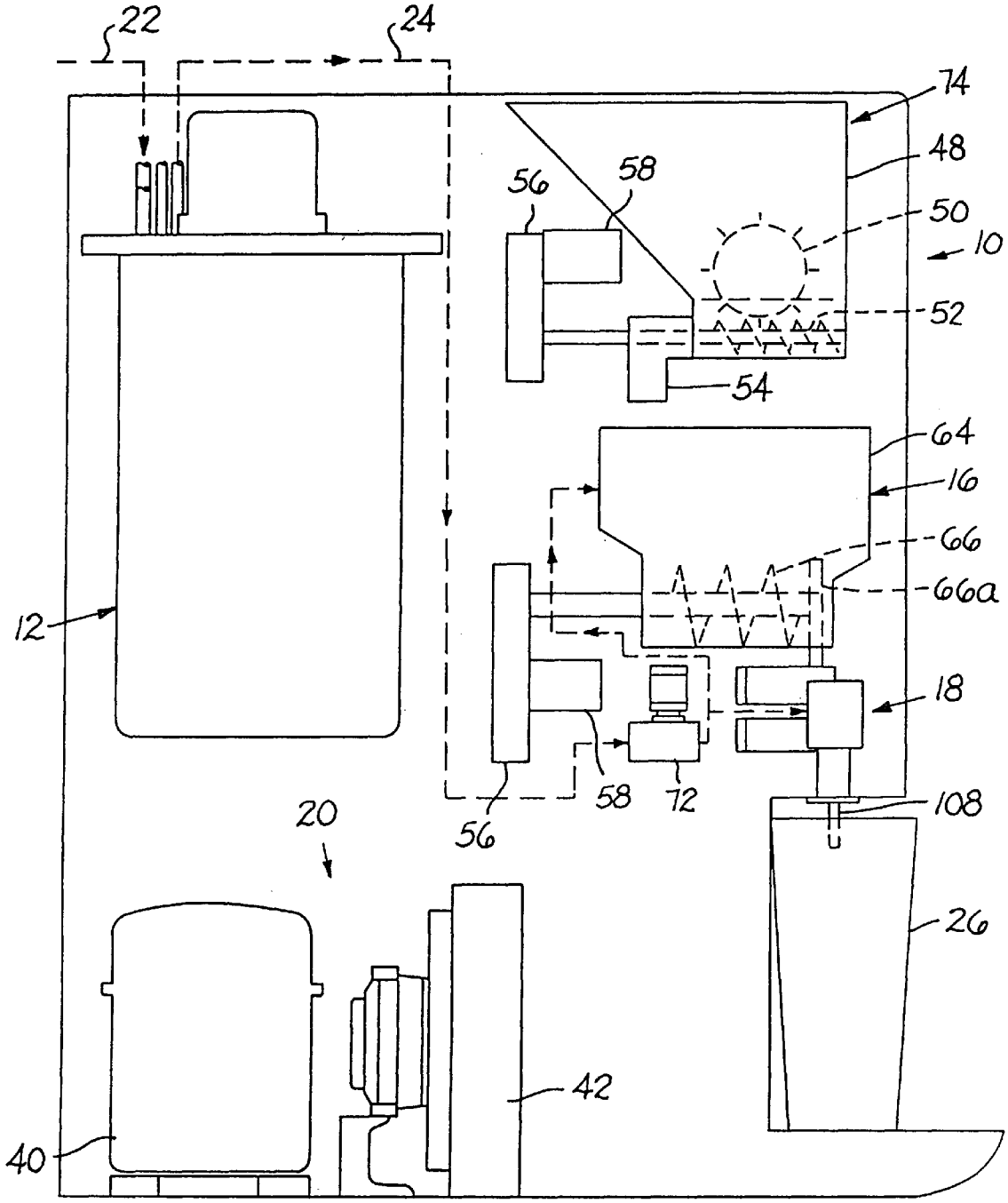
FIG. 1 is a side schematic of a beverage dispensing apparatus made in accordance with the present invention.

Reference is first made to the schematic of FIG. 1 depicting a first embodiment of the present invention. The dispenser shown generally by character numeral 10 is comprised of four major assemblies: an ice bank assembly 12; a powder hopper assembly 14; a syrup tank assembly 16; a mixing valve/dispensing assembly 18; and a compressor/fan assembly 20. Generally, as described in more detail below, the ice bank assembly 12 functions to cool water entering the assembly through line 22 connected to a remote source of potable water, typically the local water supply. Compressor assembly 20 circulates a coolant within assembly 12 to chill the potable water also circulating therethrough. Assembly 12 then supplies water under regulated line pressure through a water line indicated by dashed line 24 ultimately to the syrup tank assembly 16 and mixing valve/dispensing nozzle assembly 18 as required by the control circuitry of the dispenser 10. Powder hopper assembly 14 functions to hold the flavorant powder used to form the syrup concentrate and meter the powder in required amounts into the syrup tank assembly 16 which also receives water cooled by the ice bank assembly 12 in a corresponding ratio to form the syrup concentrate. Syrup tank assembly 16 provides syrup in a predetermined amount as needed to form a beverage within the mixing valve/dispensing assembly 18 and into a waiting container 26.

Figure 5:
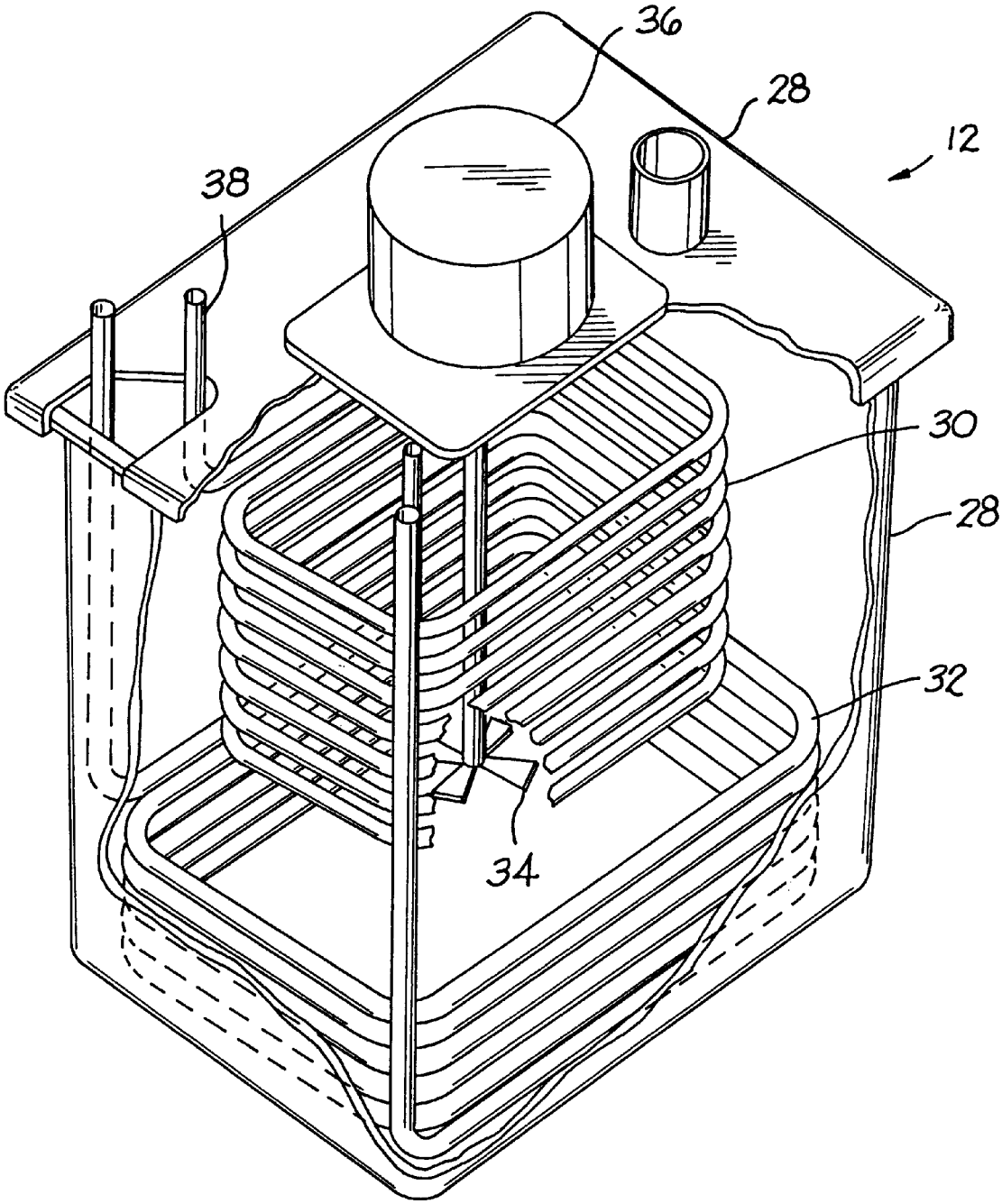
FIG. 5 is a perspective view of the ice bank used in the embodiment of FIG. 1.
Figure 6:
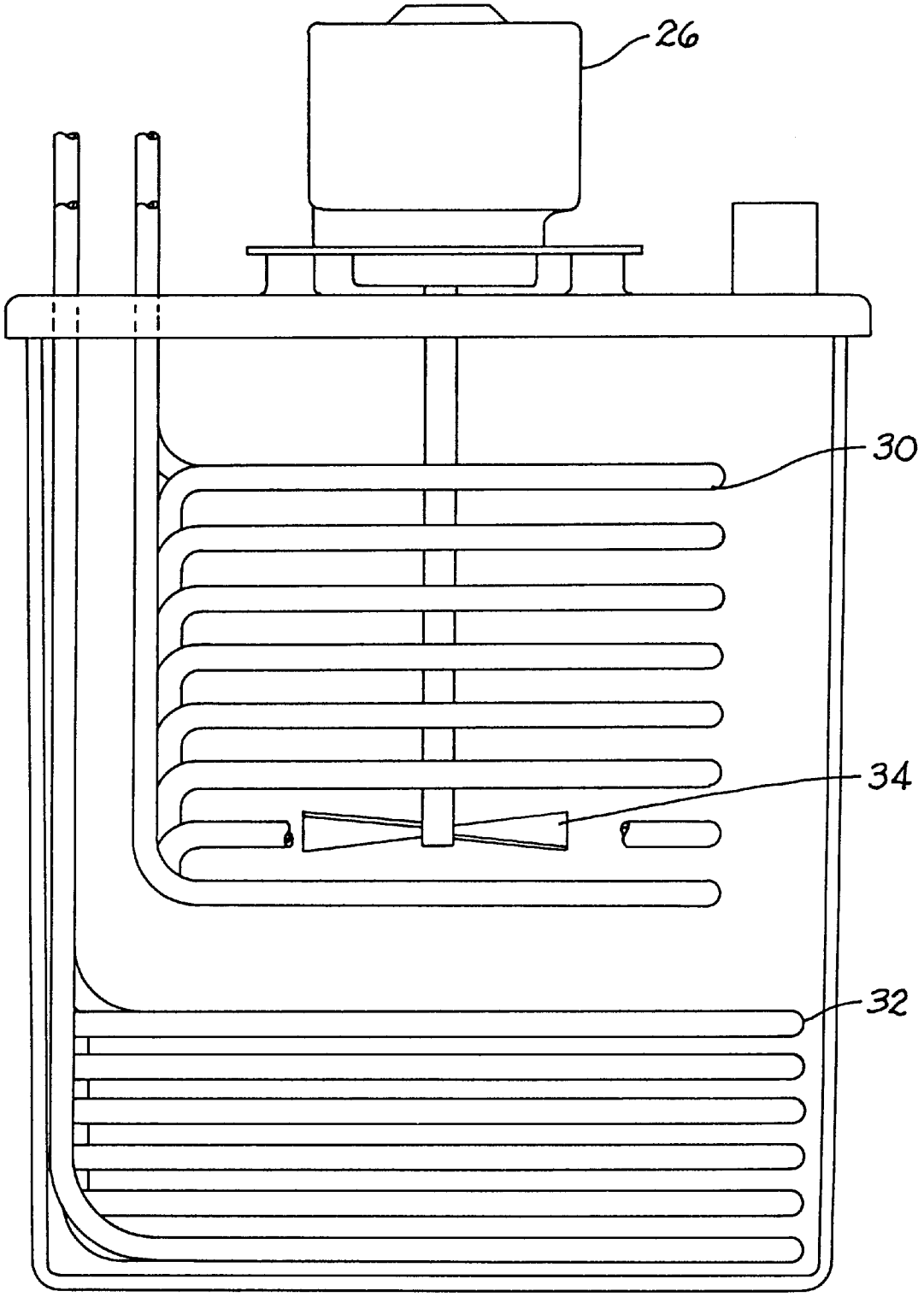
FIG. 6 is a front schematic of the ice bank of FIG. 5, partially broken away.

FIGS. 5 and 6 supply more detailed views of the ice bank assembly 12 that includes a housing 28 enclosing a first set of coils 30 that circulate a coolant fluid and a second set of coils 32 that circulate the potable water. A heat exchanging medium such as water fills the interior of housing 28 and is preferably circulated by a rotating impeller or agitator blade 34 positioned midway within the housing 28 to ensure more equal heat transfer from the potable water to the water heat exchange medium to the coolant. Agitator blade 34 is driven by motor 36 positioned on the top cover of housing 28. The coolant coils 30 are directly connected to a compressor 40 of the compressor assembly 20 by lines 38 (only one of which is shown). The compressor 40 is air cooled by circulating fan 42.

Figure 12:
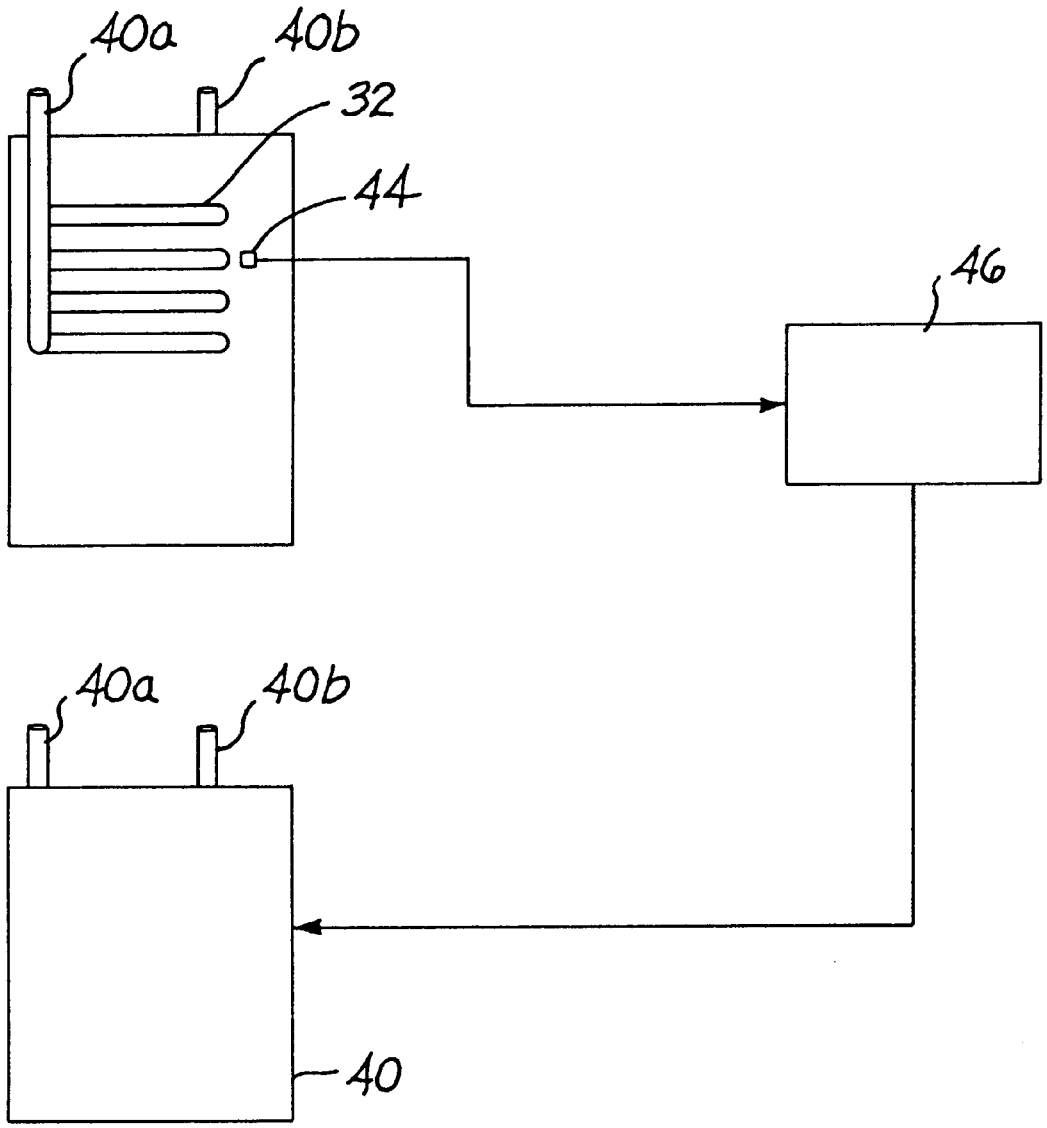
FIG. 12 is a control flow diagram of the ice bank assembly of the present invention.

It is preferably for the temperature of the potable water ultimately used to form the beverage be maintained at between about 34° F. to 36° F. for the greatest efficiency of preparation of the beverage and to ensure acceptable taste to the consumer. The potable water, of course, enters into the coils 32 at a much higher temperature than desired for the beverage and thus must be rapidly chilled to and maintained at the preferred temperature. While there are many techniques of accomplishing this, it is preferable to use sensor electrodes that monitor the thickness of the ice formed about coolant coils 30. This is an indirect measurement of the potable water temperature. The schematic for the control circuitry for the ice bank assembly 12 is shown in FIG. 12. Simply stated, when sensor electrodes 44 determine that the ice build up is too great as measured by a change in the current flow, a controller 46 will turn off the compressor 40 thereby ceasing to cool the coolant flowing along lines 40*a* and 40*b* to and from coils 32 and thus controlling the amount of ice formed in the ice bank. Conversely, when the sensors 44 detect the ice thickness to be less than predetermined thickness, controller 46 turns the compressor 40 on.

The portion of the apparatus 10 occupied by the powder hopper assembly, syrup assembly and mixer valve/dispenser assembly is preferably refrigerated to maintain the powder and syrup below about 40° F. to maintain the powder and syrup in a fresh state and to avoid the buildup of undesired bacteria in the syrup and mixer valve assemblies. This additional cooling can be accomplished through the use of a separate cooling circuit (not shown) as desired or through the local effect of the ice bank assembly itself.

From FIG. 1, it may be noticed that the powder hopper assembly 14 includes a removable hopper 48 for storing the powdered flavorant, a rotatable pin wheel 50 used to prevent bridging and agglomeration of the powdered flavorant, and a metering screw or auger 52 that moves the powdered flavorant to a metering elbow 54. Auger 52 is driven by a gear box 56 and motor 58. Auger 52 can be coupled to and used to drive the pin wheel 50. The auger motor may be, for example, a 24 VDC motor. The gear box 56 preferably provides a constant RPM output irrespective of the torque requirements caused by changing powder loads above the auger 52 and/or types of powders placed in the hopper. Augers provide an especially accurate throw of transported material and thus are ideally suited to a task of metering those amounts needed to ensure proper syrup concentration.

Figure 13:
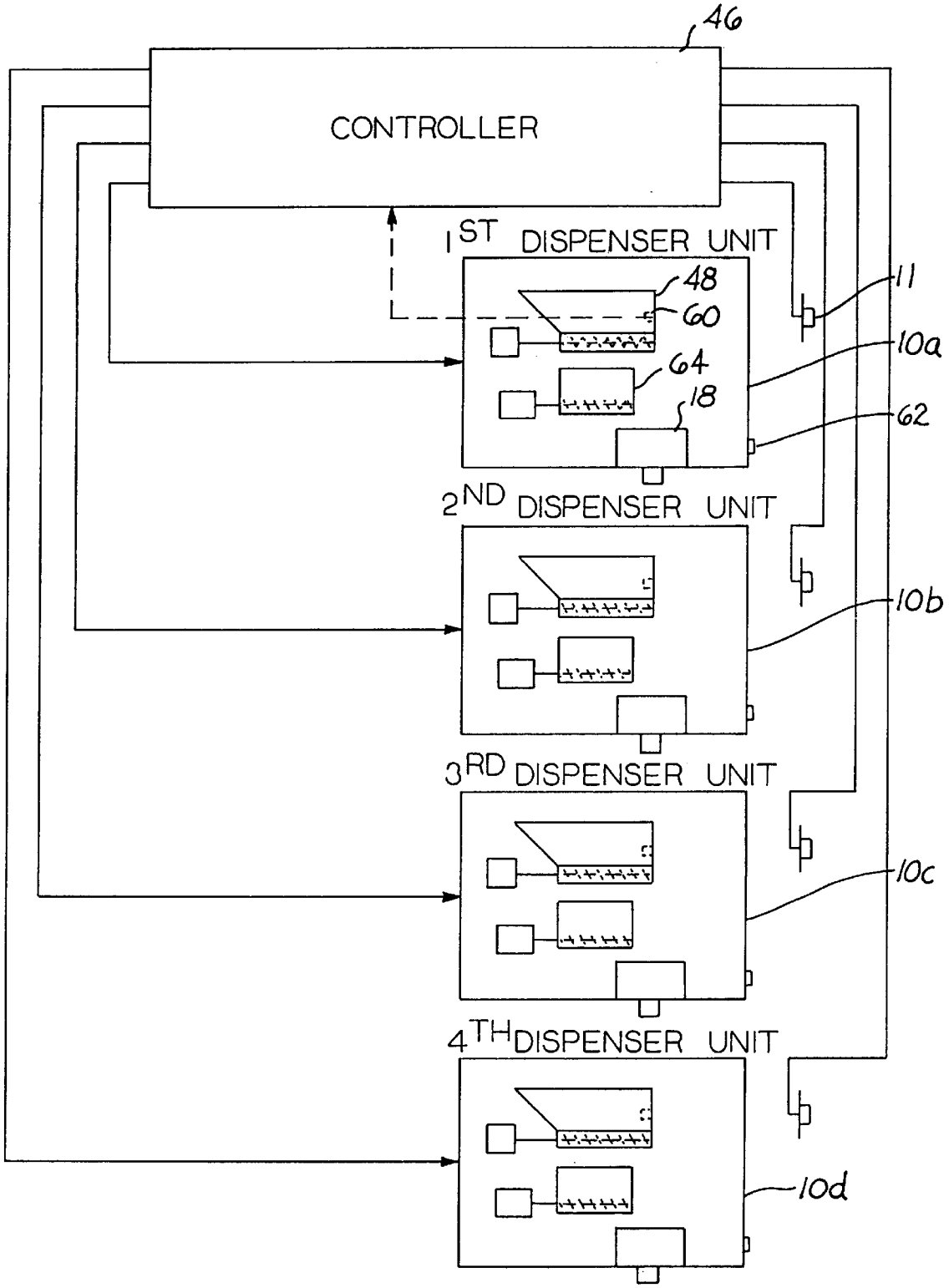
FIG. 13 is a control flow diagram showing the relationship of the controller and four units of a dispenser apparatus in accordance with the embodiment illustrated in FIG. 1.

To indicate when the powdered flavorant needs to be replenished in hoppers 48, sensors 60 (as shown in FIG. 13) may be employed within the hopper to interact with the dispenser controller 46 and, for example, illuminate a small indicator light 62 when the powdered flavorant level of the hopper associated with the sensor 60 is low. Sensors 60 could take the form of paired sensors, for example, that comprise a capacitor, the capacitance of which changes with the presence or absence of the powdered flavorant between them. The sensors 60 may be located a level within the hopper 48 indicative of the minimum permissible powder level.

As again illustrated in FIG. 1, the syrup tank container assembly 16 is positioned immediately below the powder hopper assembly 14 and includes the syrup tank 64 and an auger 66 with a vane pump 66*a* mounted on the end thereof. Auger 66 serves the purpose of moving and otherwise agitating the syrup, an important feature since many syrup concentrates have sugars or the like that tend to precipitate out of solution, particularly at low temperatures. The vane pump 66*a* is a typical rotary pump having flexible members that push the liquid in pulses to an opening such as outlet 68 (seen in FIG. 15 only) and serves the function of metering precise amounts of the syrup upon drink demand. The pump 66*a* is driven at an RPM determined to provide the proper syrup to water ratio for the particular beverage to be formulated during mixing. It may be desirable to reverse the rotation of the auger when solely being used for agitation to avoid pumping the syrup by the vane pump 66*a*. The potable water to be mixed with the powdered flavorant is provided in the proper amount, preferably from the ice bank assembly 12, but alternatively could be provided from a separate remote water supply, if desired.

Figure 7:
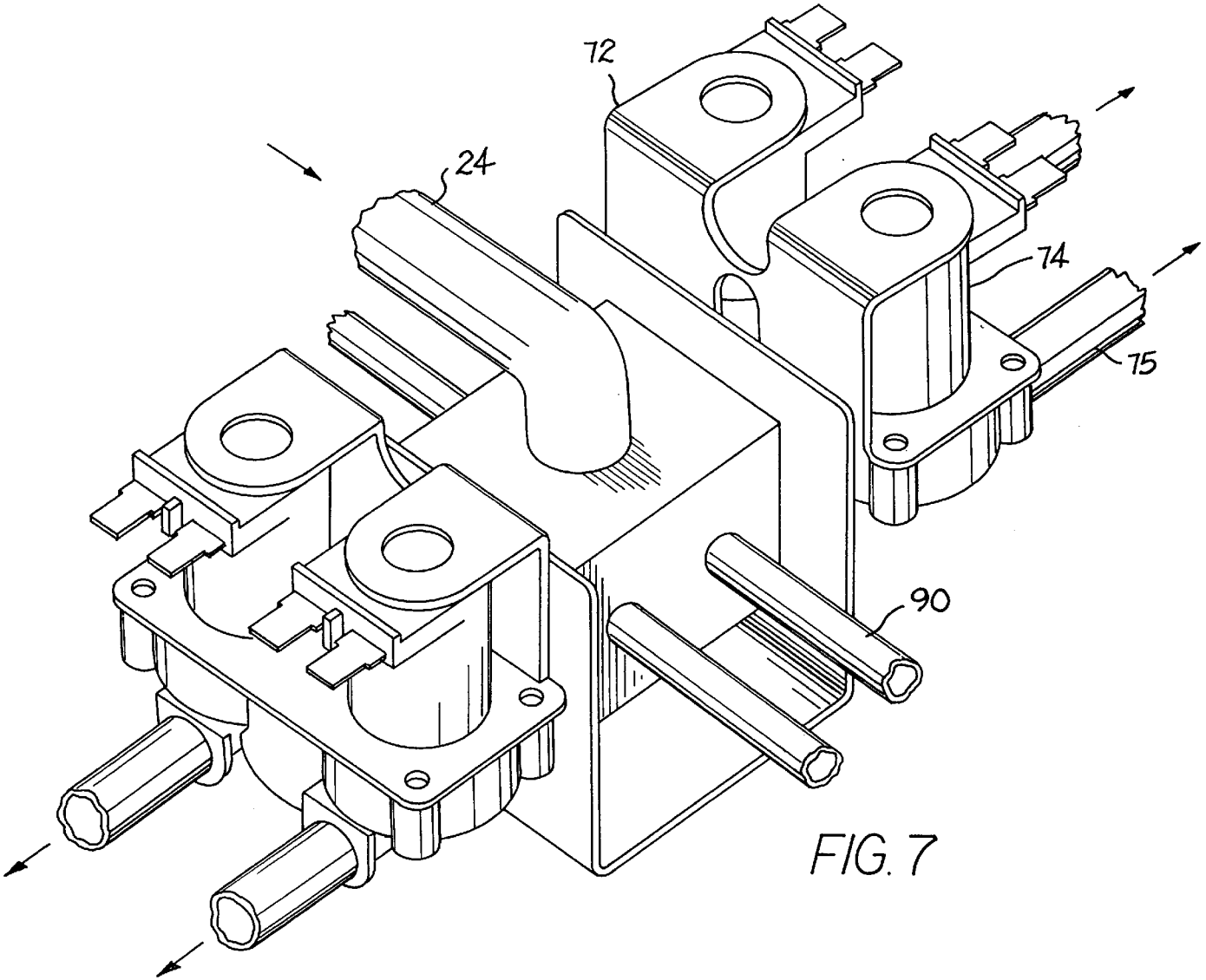
FIG. 7 is a perspective view of four-way solenoid manifold used in the present invention.
Figure 8:
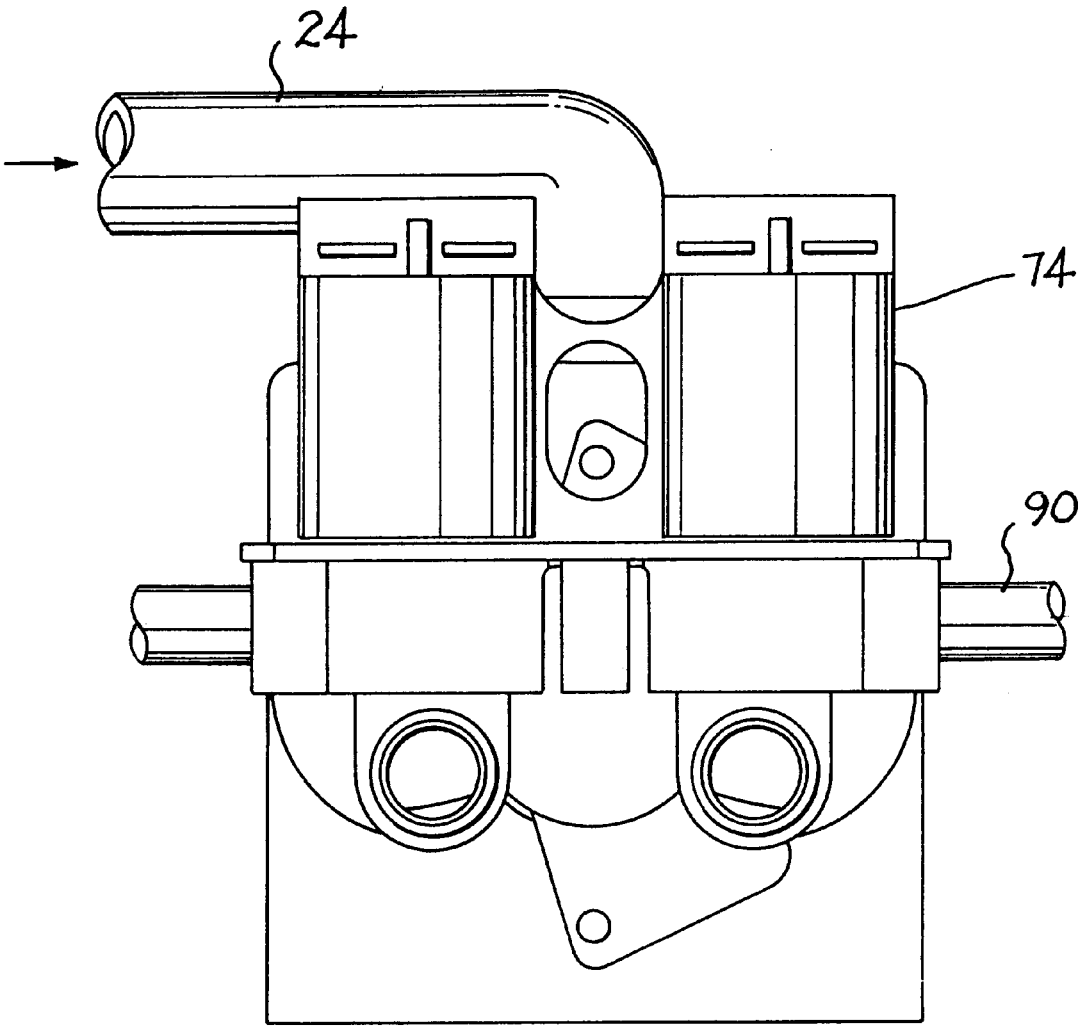
FIG. 8 is a side view of the four-way solenoid valve manifold of FIG. 7.
Figure 9:
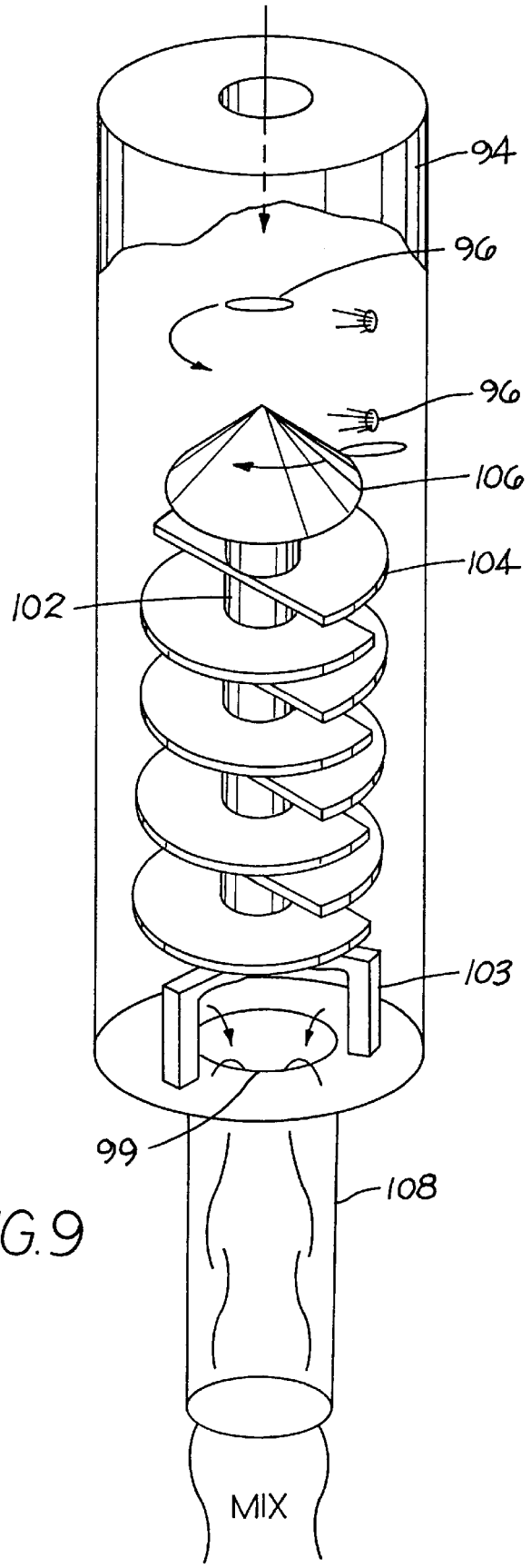
FIG. 9 is a perspective view of a mixer used in the present invention illustrating the internal components thereof.
Figure 10:
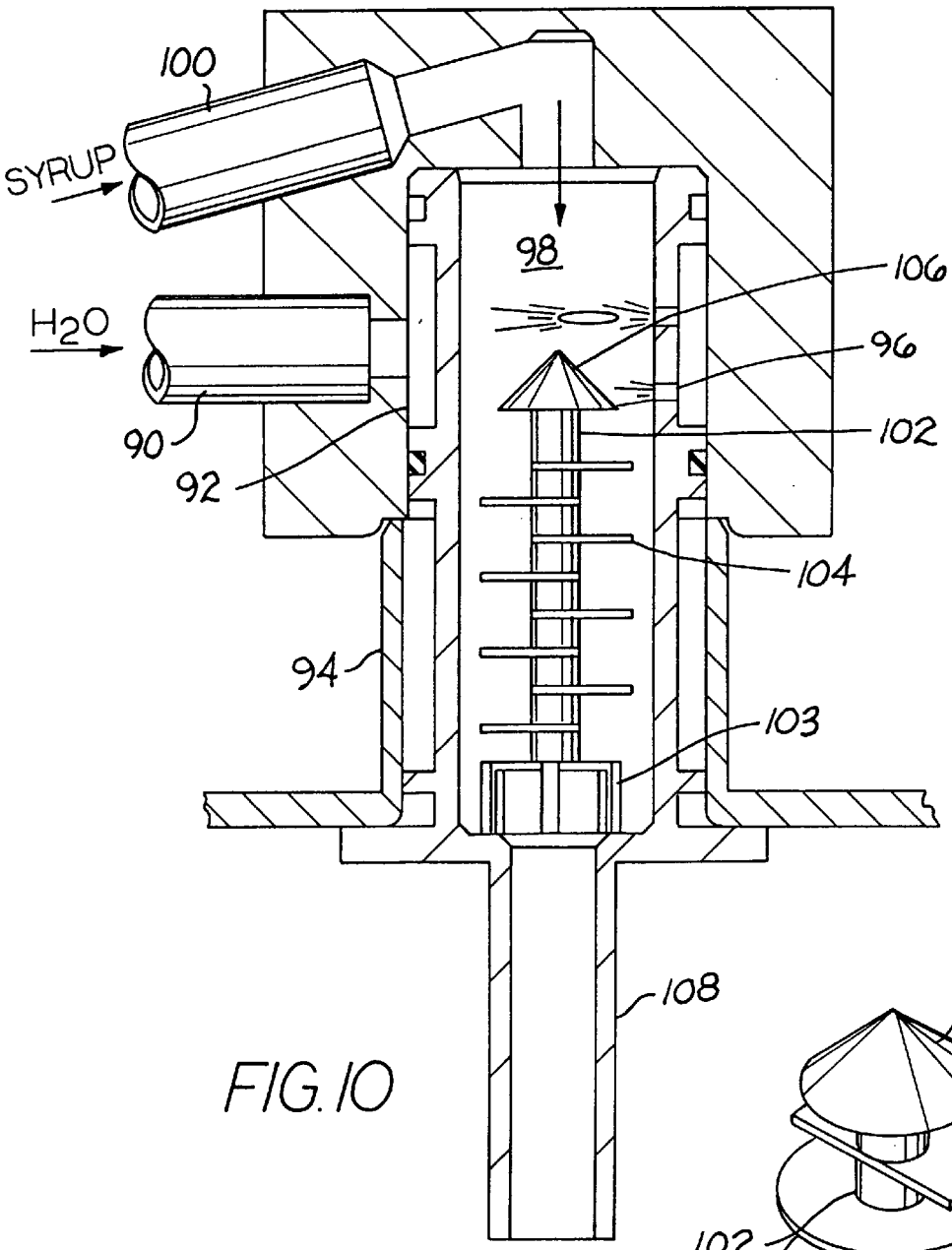
FIG. 10 is a side section view of the mixer of FIG. 9.
Figure 11:
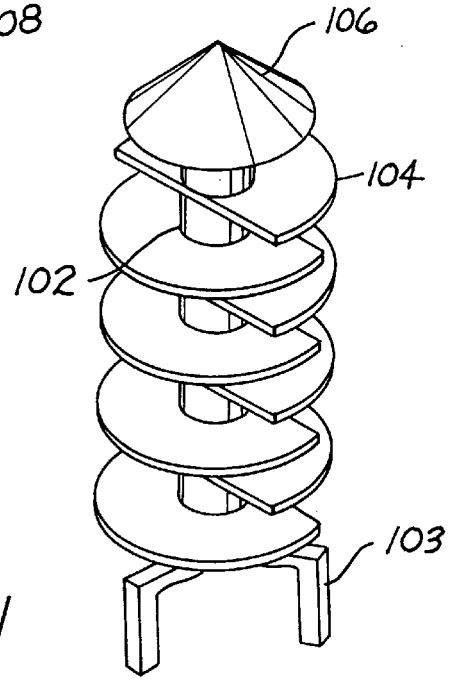
FIG. 11 is a perspective view of a static mixing element positioned within a chamber of the mixer of FIG. 9.

As best seen in FIGS. 7 and 8, a water manifold 72, serving to distribute the potable water to both the syrup assembly 16 and the mixer valve/dispenser assembly 18, includes four solenoid valves 74. Each valve 74 is connected by a water line 75 to an associated syrup assembly 16 of each dispensing unit of the beverage apparatus 10, thereby permitting water to be distributed to an individual syrup assembly as selected. The manifold 72 also has a direct water line 90 to each mixing assembly 18. Because water pressure varies depending upon the remote water source selected, it is preferable that a water regulator 70 be placed in line 24 to regulate the line pressure of the cooled water to a predetermined pressure such as, for example, about 20 psi.

Reference is now made to FIGS. 9, 10, 11 and 15 to illustrate the component make of assembly 18. When a beverage has been demanded by a consumer water and syrup are supplied in the requisite amounts to mixer valve/dispenser assembly 18. Water moves along line 90 from manifold 72 to an open valve 114 in assembly 18 and into a cavity 92 circumscribing a cylindrically shaped interior member 94. A plurality of apertures 96 place the cavity 92 in communication with an interior mixing volume 98. At least a pair of the apertures 96 are essentially tangential to the wall in the interior volume but oriented 180° with respect to each while others are perpendicular to the walls. This causes the chilled water entering the volume under line pressure to swirl around the wall of the interior volume 98 impacting and causing the water to swirl within the volume 98. The syrup in tank 64 being under continuous agitation by vane pump 66 is gently moved into the tank opening communicating with line 100, and, when solenoid valve 116 is opened, moved mainly by gravity into the swirl of chilled water in the volume 98. To further ensure mixing, a static mixer column 102 maybe placed within the volume 98. As illustrated, column 102 extends upwardly from a plurality of feet 103 spacing the column above the base forming the bottom wall of mixing volume 98. Attached to column 102 are a plurality of spaced half circle stages 104 each oriented to be 180° out of phase with an adjacent stage 104. A conically shaped top member 106 is attached to the top of column 102. As the syrup enters mixing volume 98 above top member 106, it impacts the top member and is forced outwardly and encounters the swirling water. The syrup and water are further mixed due to the cascading action of the stages 104 where the mixed beverage then exits the mixing volume 98 through opening 99 into nozzle 108.

Figure 14:
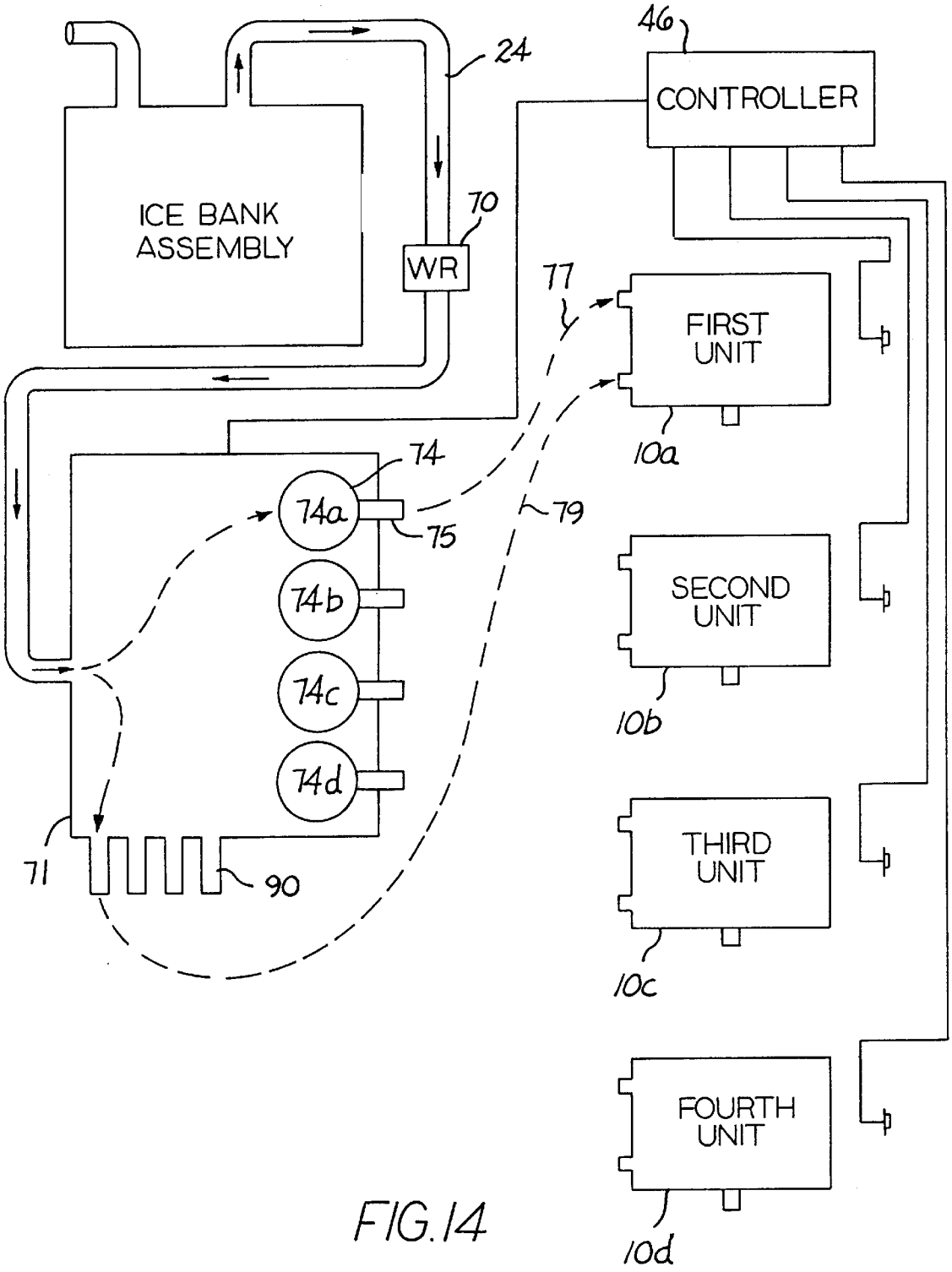
FIG. 14 is a control flow diagram showing the liquid flow in a four unit dispenser apparatus in accordance with the embodiment of FIG. 1.
Figure 15:
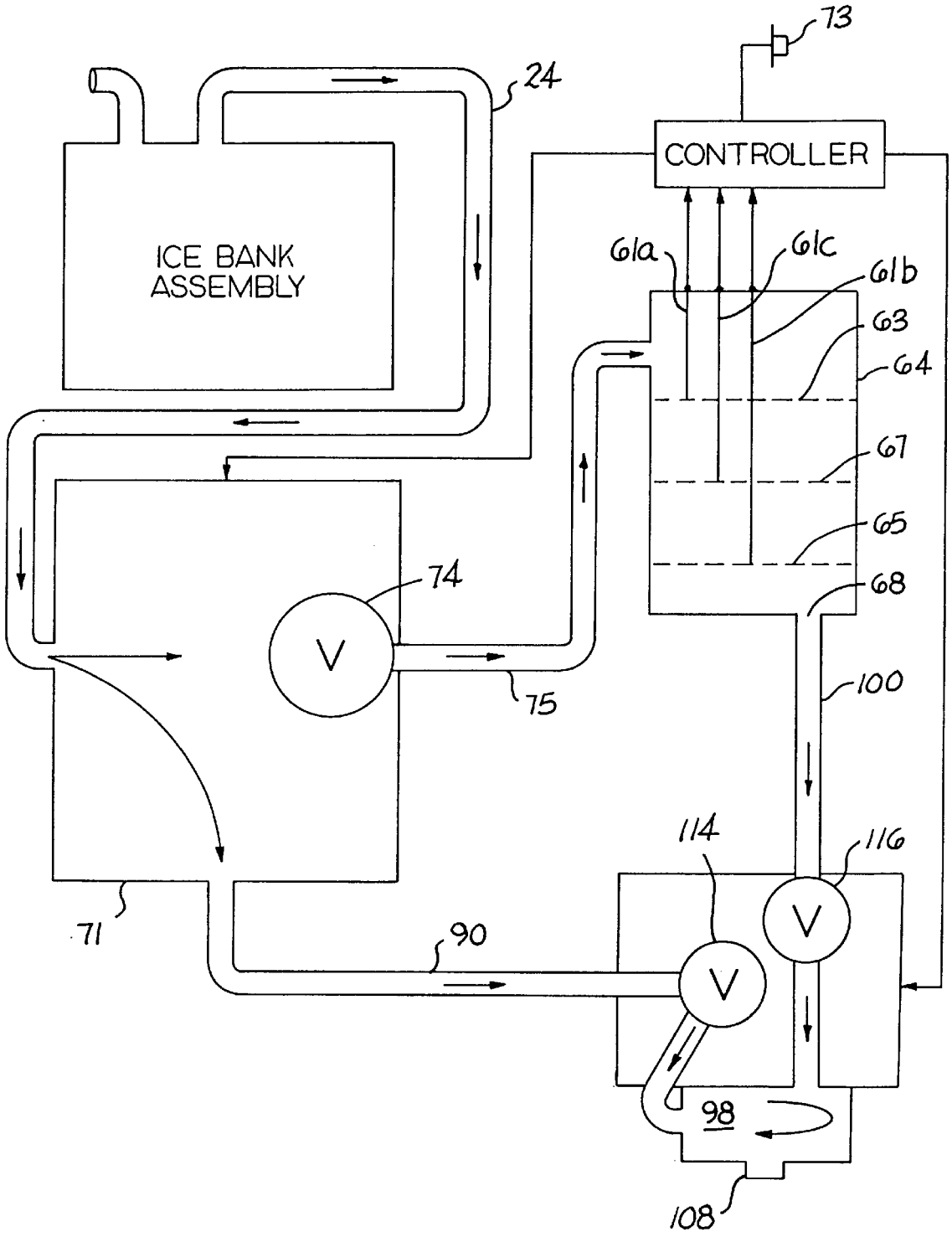
FIG. 15 is a control flow diagram showing the liquid flow with respect to a single unit of a dispenser apparatus in accordance with the embodiment of FIG. 1.

Reference is now made specifically to FIGS. 13, 14, and 15. FIG. 13 which shows a general schematic of the relationship an apparatus controller 46 and four units 10*a*, 10*b*, 10*c*, and 10*d* of an multi-beverage dispensing apparatus 10 of the present invention. FIG. 14 depicts the flow the water of water to the various units 10*a*, 10*b*, 10*c*, and 10*d*. For clarity, the dashed line 77 shows potential water flow from an associated valve 74*a* to the syrup tank of unit 10*a* while dashed line 79 represents potential water flow to the assembly 18 of unit 10*a*. FIG. 15 illustrates the water flow from the manifold shows the water flow to the mixing valve/dispensing assembly 18 of the selected unit. When a select button 11 is depressed on the front of the unit indicating a particular beverage selection, controller 46 starts the beverage sequence in the selected unit. An appropriate valve 114 of the mixer valve/dispensing assembly 18 is opened by controller 46 and cooled potable water from the ice bank assembly 12 moves under line pressure through line 24 and the water regulator 70 to the manifold 72. Water then flows directly into the assembly 18. Valve 114 remains open for a predetermined time period so that the precise volume of the water to be used to form the beverage moves into the mixing chamber 98. Similarly, valve 116 in the syrup line 100 is opened allowing syrup to be pumped and metered by vane pump 67 directly into chamber 98 for mixing with the water. As stated above, the water regulator 70 is important to ensure that the pressure is essentially the same from apparatus to apparatus, allowing the various settings and time durations imposed by the controller to be essentially constant.

Each unit of the apparatus 10 may be set to accommodate syrup either in one-half or full capacity. Full capacity is indicated schematically by level line 63 while half capacity is shown by level line 67. When the syrup level falls below the selected capacity level to a predetermined low level shown by level line 65, sensors 61*a*, 61*b*, and 61*c* cooperating with controller 46 act to bring the syrup back to the selected capacity. While the sensors may be of various types, a preferred arrangement is the use of paired high and low sensors such as described in commonly assigned U.S. Pat. No. 5,195,422 incorporated by way of reference herein. Basically when low probe 61*b* senses syrup level has dropped to or below level 65, controller 46 responds by opening valve 74 until the syrup level reaches the selected capacity level line at which point the valve 74 is closed. During this time period, powder auger 52 is rotated to meter a predetermined amount of powder into syrup tank 64 proportional to the amount of water added to the tank 64.

The syrup is then allowed to sit undisturbed except for agitation for a period of time in order that proper pH level is reached in the syrup before being used to form a beverage hereinafter called the "resident" time. As stated above, reaching the proper pH level is an important consideration as it affects the 'taste' quality of the resulting beverage. Dispensing a beverage using a syrup or powder directly that has not reach the proper pH level often results in the drink being described as watery or tasteless. The controller 46 is set to prevent dispensing when water is being added to a tank 64 and for a predetermined time period thereafter. That is, controller 46 disable the dispensing sequence for the predetermined resident time for the particular unit undergoing syrup replacement. The precise resident time of a syrup depends upon the type of beverage with some requiring longer resident periods than others, but generally requires a minute or more.

Agitation of the syrup in tank 64 is preferably done at set time periods. For example, the controller 46 may count for a certain time interval between periods of agitation and then cause the motor to rotate the auger 66 (in a direction opposite the direction needed by vane pump 66*a*) for agitation of the syrup. Of course, agitation also occurs during metering since the auger 66 is also mounted on the same shaft as the vane pump 66*a*.

The apparatus of the present invention also permits the periodic flushing of the various components coming in contact with syrup and the beverage. This is accomplished by opening all valves (74, 114, 116) of the apparatus for a predetermined time period allowing water to move through and flush all lines (24, 75, 90, 100), the surfaces of the components such as tank 74, vane pump 66, the internal components of the mixer member 94, and nozzle 108. Schematically shown in FIG. 15, a switch 73 for each unit is preferably positioned out of reach of individuals operating the front panel of the apparatus 10 and, when closed, causes the controller 46 to place the selected unit in a flush mode for the predetermined flush time period.

Figure 16:
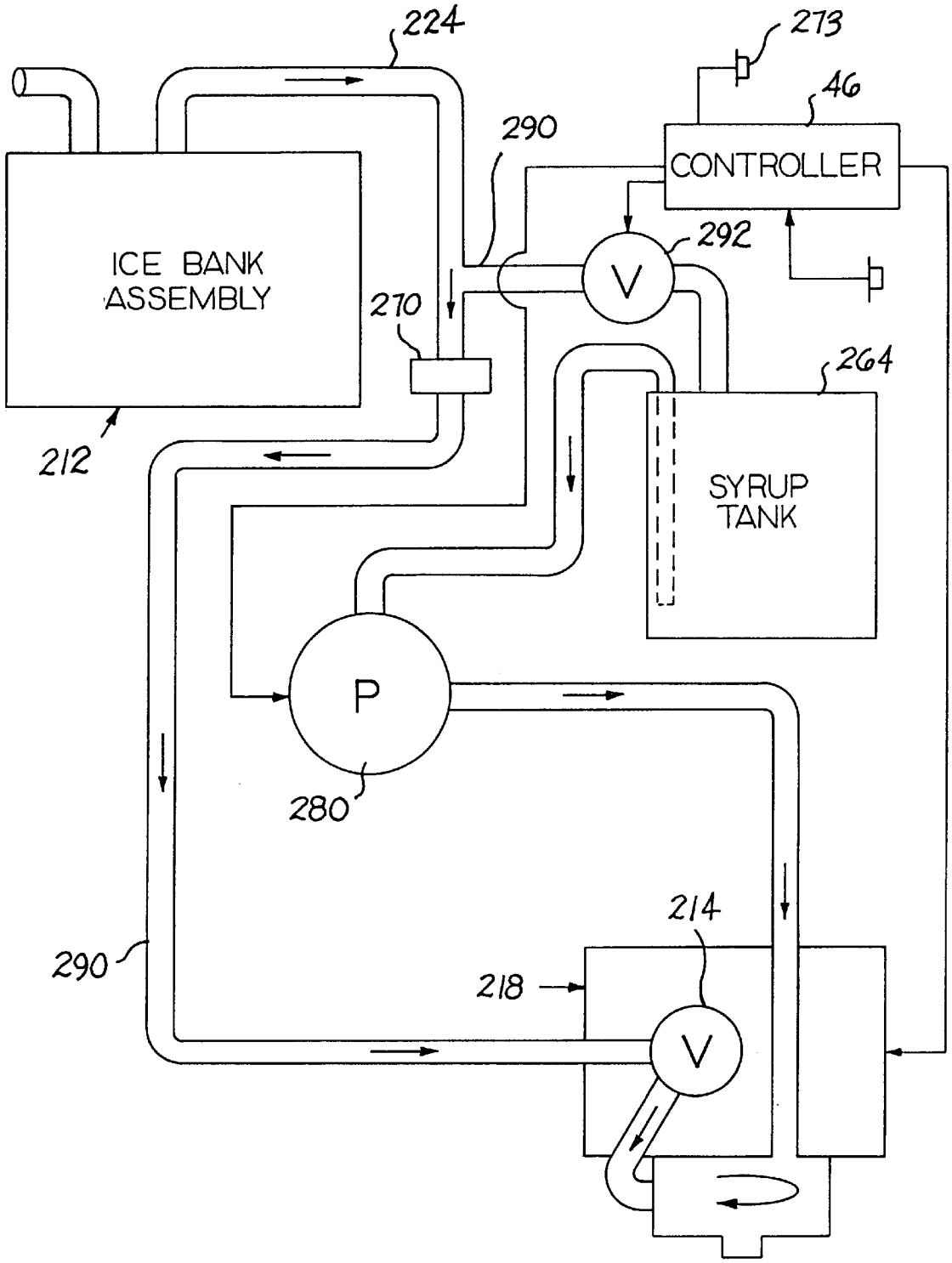
FIG. 16 is a control flow diagram showing the liquid flow with respect to a single unit in accordance with the embodiment of FIG. 2.

FIG. 2 represents a second embodiment of the present invention in which the powder hopper assembly is not used to make the syrup. Instead, in this embodiment, the syrup is may be made by manually feeding a predetermined amount of powder flavorant into the container tank 264 and then mixed with an appropriate amount of chilled water agitated by agitator 282. Alternatively, tank 264 may be removed and syrup made in the container at position remote from the dispesner and replaced. Except for flushing, there may be no feed of chilled potable water into the container tank 264 as the container is filled externally. The chilled water from ice bank assembly 212 moves through regulator 270 to the mixer valve/dispensing assembly 218. In multi-unit beverage dispensers the water line may first proceed to a water line splitter 272 and then be directed to individual assemblies 218. The syrup from the tank 264 is delivered to the mixer/dispenser assembly 218 by a pump 280, preferably a peristaltic type pump. As in the previous embodiment, however, the syrup in the tank 264 is periodically agitated by an rotating agitator 282 magnetically coupled to a shaft of a motor 284. The control schematic of FIG. 16 illustrates the relationship between the controller 46, the syrup tank assembly 216, and mixing valve/dispensing assembly 218. When selector switch 211 is depressed or closed, controller 46 energizes pump 210 and opens the associated valve 274 for a predetermined amount of time or as long as switch 211 is depressed and cooled potable water flows to the associated mixer valve/dispensing assembly 218 thorough now opened solenoid valve 214. Simultaneously, pump 280 pumps in a precisely metered amount syrup in a proportional ratio from tank 264 through line 220 to the mixer 218. Water and syrup are mixed as before and the beverage dispensed into a container.

To provide for flushing, the tank 264 may be connected to a remote source of water through line 290 and valve 292. For clarity, water line 290 is shown broken. As with the embodiment illustrated in FIGS. 1 and 14, a switch 273, when closed, opens all valves (214, 290) and energizes pump 280 to permit the flushing of all surfaces coming into contact with the syrup.

FIG. 3 represents still another embodiment in which a powder hopper apparatus 314 is employed with a syrup assembly 316 that uses a peristaltic type pump 380 instead of a vane pump. Thus, the operation of the syrup flow is essentially the same as in the FIG. 2 embodiment with the syrup being metered directly to mixing assembly 318. Water flow is essentially the same as the flow described for the FIG. 1 embodiment with the water flowing through a water regulator (not shown) to a water splitter 372 to mixer assembly incorporating a valve (not shown). As before a controller operates to open the valve in the mixer assembly while energizing the pump 380 upon demand to provide for the beverage. Flushing can be accomplished similar to the FIG. 1 embodiment as desired.

From the description above, those with ordinary skill in the art to which the invention pertains will be able to modify and change the apparatus and components thereof without departing from the spirit and scope of the attached claims.

What is claimed is:

1. A beverage dispenser system for the preparation and dispensing of a selected beverage of a predetermined volume from a housed syrup container comprising:

an ice bank assembly connected to a remote system of potable water at line pressure for the chilling of said potable water;

a water line communicating with said ice assembly for carrying said chilled water from said assembly at line pressure;

a container for receiving the chilled water and beverage constituents including a flavorant;

an agitating element mounted for movement within said container for agitating the chilled water and beverage constituents into a concentrated syrup and maintaining said constituents of said syrup in solution thereby ensuring said syrup has essentially the same concentration at all points within said container;

a first element for metering said syrup from said container into a first predetermined amount;

a second element in communication with said water line for metering said water line into a second predetermined amount, said first predetermined amount being proportional to said second predetermined amount; and a mixer component for receiving and mixing said first predetermined amount with said second predetermined amount at line pressure thereby forming a beverage and dispensing said beverage into a container.

2. The system of claim 1 including a powder hopper assembly for the housing of a powdered flavorant, said assembly including a metering element for metering a third predetermined amount of said flavorant to said syrup container, said container connected to a source of potable water and a means for metering said potable water into a fourth predetermined amount, said third predetermined amount being proportional to said fourth predetermined amount.

3. The apparatus of claim 2 in which said first element comprises a vane pump.

4. The apparatus of claim 3 in which said agitating member is an auger for periodically moving said syrup in said container.

5. The apparatus of claim 1 in which said first element is a peristaltic pump for metering said syrup and moving said syrup from said container to said mixer assembly.

6. The apparatus of claim 1 in which said container is connected to a remote source of water for periodic flushing of said container.

7. The apparatus of claim 6 including a controller, said controller in response to an external signal for causing water to flow over all surfaces of said apparatus coming into contact with said syrup.

8. The system of claim 1 including a control means for preventing dispensing of said beverage following the receiving of said beverage constituents until said syrup concentrate has reached a predetermined pH level.

9. A beverage dispensing apparatus for the making and dispensing of a beverage made from a liquid and a flavorant in the form of a soluble powder comprising a liquid cooling assembly for chilling said liquid and connected to a source of said liquid;

a syrup assembly in communication with said liquid cooling assembly and including a tank for holding syrup of a predetermined ratio of liquid to powder flavorant;

a powder assembly for holding and metering said powder flavorant into said tank, a first valve component for selectively allowing said chilled liquid to flow into said tank;

an agitator element in said tank for continuously moving said syrup;

a mixing assembly having a mixing chamber in communication with said cooling assembly and said syrup assembly for mixing said syrup and liquid into a beverage;

a first metering component for metering chilled liquid to said mixing chamber in a first predetermined amount;

a second metering component for metering said syrup to said mixing assembly in a second amount proportional to said first amount; and a controller for preventing dispensing of a beverage by said apparatus for a predetermined time period following said powder assembly metering said powder flavorant to said tank and said first valve component allowing chilled liquid to flow to said tank.

10. The apparatus of claim 9 including an operating switch, said first and second metering components operating in response to said controller when said operating switch is closed.

11. The apparatus of claim 9 in which said powder assembly meters powder flavorant into said tank in an amount proportional to the chilled liquid flowing into said tank from said first valve component.

12. The apparatus of claim 11 in which said syrup assembly has a sensor component for detecting a low level of said syrup in said tank, said control means in response to said sensor component detecting said low level of said syrup energizing said powder assembly to meter said powder flavorant and causing said first valve component to allow said chilled liquid to flow into said tank.

13. The apparatus of claim 12 in which said sensor component closes said first valve component after a predetermined time period thereby determining the amount of chilled liquid flowing into said tank.

14. The apparatus of claim 12 in which said powder assembly includes a hopper for holding said powder and an auger driven under constant torque positioned in said hopper for metering said powder into said predetermined amount.

15. The apparatus of claim 9 in which said second metering component is a vane pump positioned in said tank.

16. The apparatus of claim 9 in which said first metering component is a solenoid valve.

17. The apparatus of claim 9 in which said second metering element is a pump.

18. An apparatus for the dispensing of a beverage made from a syrup mixed with chilled water comprising a source of chilled water;

a storage container holding a powder flavorant;

a tank for holding a quantity of syrup;

a mixing chamber communicating with said source of chilled water and said tank for mixing syrup and water into a beverage, said mixing chamber connected to a dispensing nozzle for dispensing said beverage into a beverage container;

a first metering device associated with said storage container for metering a first predetermined amount of powder into said tank;

a second metering device for metering a second predetermined amount of chilled water into said tank, said first predetermined amount being proportional to said second predetermined amount; and control means for preventing dispensing of said beverage following the metering of said powder flavorant and chilled water into said tank until said syrup has reached a predetermined pH level.

* * * * *